US009370697B2

(12) United States Patent
Beno et al.

(10) Patent No.: US 9,370,697 B2
(45) Date of Patent: Jun. 21, 2016

(54) GOLF CLUB HEAD COMPRISING MULTIPLE MATERIALS

(71) Applicant: Cobra Golf Incorporated, Carlsbad, CA (US)

(72) Inventors: Tim A. Beno, San Diego, CA (US); Karl Clausen, Carlsbad, CA (US); Richard Romo Sanchez, Temecula, CA (US); Cameron J. Day, Aliso Vaiejo, CA (US); Thomas W. Preece, San Diego, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 96 days.

(21) Appl. No.: 14/264,147

(22) Filed: Apr. 29, 2014

(65) Prior Publication Data

US 2014/0323237 A1 Oct. 30, 2014

Related U.S. Application Data

(60) Provisional application No. 61/817,091, filed on Apr. 29, 2013.

(51) Int. Cl.
*A63B 53/04* (2015.01)
*A63B 59/00* (2015.01)

(52) U.S. Cl.
CPC ..... *A63B 53/04* (2013.01); *A63B 53/0466* (2013.01); *A63B 53/0475* (2013.01); *A63B 59/0092* (2013.01); *A63B 60/54* (2015.10); *A63B 2053/042* (2013.01); *A63B 2053/0408* (2013.01); *A63B 2053/0425* (2013.01); *A63B 2053/0429* (2013.01); *A63B 2053/0454* (2013.01); *A63B 2209/00* (2013.01)

(58) Field of Classification Search
CPC ..... A63B 2053/0429; A63B 2053/0425
USPC ..... 473/342, 345, 348, 349
See application file for complete search history.

(56) References Cited

U.S. PATENT DOCUMENTS

| | | | | | |
|---|---|---|---|---|---|
| 5,467,983 | A * | 11/1995 | Chen | A63B 53/04 | 473/342 |
| 2002/0065146 | A1* | 5/2002 | Kusumoto | A63B 53/04 | 473/345 |
| 2006/0079345 | A1* | 4/2006 | Gibbs | A63B 53/0466 | 473/329 |
| 2008/0125245 | A1* | 5/2008 | Yang | A63B 53/04 | 473/342 |
| 2011/0256957 | A1* | 10/2011 | Roach | A63B 53/04 | 473/332 |

FOREIGN PATENT DOCUMENTS

JP 2003102878 A * 4/2003

* cited by examiner

*Primary Examiner* — Benjamin Layno
(74) *Attorney, Agent, or Firm* — Brown Rudnick LLP; Mark S. Leonardo

(57) ABSTRACT

A golf club head having an insert mechanically coupled to a frame. The construction allows a golf club head to be fabricated with a combination of dissimilar materials, resulting in a club head with improved performance. In some embodiments, the insert comprises an outer insert material, an inner insert material, and a sandwiched material. The sandwiched material may be constructed with a plurality of voids having a varying distribution, thereby resembling a biological structure. Methods for forming a golf club having an insert mechanically coupled to a frame are also disclosed.

8 Claims, 10 Drawing Sheets

GOLF CLUB HEAD COMPRISING MULTIPLE MATERIALS

RELATED APPLICATION

This application claims priority to U.S. provisional patent application No. 61/817,091, filed Apr. 29, 2013, which is incorporated by reference herein in its entirety.

FIELD OF THE INVENTION

The invention relates to golf club heads having inserts mechanically coupled to a frame, using a process such as forging, or bonded to a frame using a bonding material. In some embodiments, the golf club head is constructed from multiple different materials.

BACKGROUND

Golf clubs undergo many stresses when they strike a golf ball. The face undergoes compressive impact forces as it strikes the ball, the sole undergoes compressive and lateral impact forces as it strikes the ground during the downstroke, and the hosel undergoes twisting and torsional forces as the shaft brings the club head through the stroke. The transitional portions of the club head, e.g., the face/crown interface, also experience tremendous stress because of the convergence of different types of force from multiple directions. Furthermore, after the initial impact, a good deal of energy from the impact is dissipated as vibration through the club head.

To survive repeated striking, a golf club head must be strong and have good energy-damping properties. However, a golf club head must also be lightweight, allowing a golfer to achieve head speeds of 100 miles per hour, or greater. In view of these needs, golf club manufacturers typically use materials such as aluminum alloys, steels, and titanium alloys, which provide a desirous balance of weight and strength. Nonetheless, there is no perfect material from which to make the entire club head—each material has unique properties, such as weight, tensile and compressive strength, and flexibility. Clubs made from a single material will excel in some areas (e.g., face hardness), while faring poorly in others (e.g., flexibility). For example, it is beneficial to use hardened steel for the club face, but hardened steel is not a good material for the hosel, because it is brittle.

By incorporating multiple materials into a club head, it is possible to achieve a club with many desired properties, such as a hard face, an energy damping body, and a flexible hosel. However, joining mixed materials can be problematic. For example, it is difficult to weld titanium and aluminum alloys together because of their disparate melting temperatures. Furthermore, when different materials are welded together the joint may be prone to failure because the materials on either side of the transition have different mechanical properties. In such instances, vibrations and thermal loads cannot be transmitted evenly through the joint, increasing the likelihood of failure at the joint. Other means for joining the dissimilar materials, such as adhesives and fasteners, also have shortcomings. Like welds, adhesives are prone to failure over time because of the confluence of materials with dissimilar mechanical properties. Fasteners are less prone to failure, but they add considerable weight to the club, thus requiring weight to be removed from other areas of the club to make the club head lighter and/or to meet USGA weight requirements.

Accordingly, there still remains a need for ways to fabricate golf clubs having multiple materials.

SUMMARY OF THE INVENTION

The invention provides golf club heads, including drivers, hybrids, and irons, having multiple portions of the head made from different materials. This construction allows a club head to use materials optimized for each specific portion of the club head. The resulting club will have improved drive length, straighter trajectories, and better vibration damping. The golf clubs of the invention overcome many of the difficulties associated with joining dissimilar materials by using an insert and frame construction, whereby the insert and frame are mechanically coupled, e.g., with forging. The insert may comprise a single material, such as titanium or aluminum, or the insert may comprise a combination of materials such as a metal and an elastic material, or a sandwiched cellular structure.

In an embodiment, a club head includes a frame and an insert mechanically coupled to the frame, e.g., by forging the frame to the insert. The mechanical coupling allows the insert to be constructed from any of a number of materials. In some instances, the mechanical coupling allows a club head to be constructed from a set of materials that would not otherwise be suitable for use in constructing a club head. The insert may make up a portion of the club head, such as a face, a crown, or a sole. The frame may be integrated into the body of the club head, or the frame can be joined to the club head. In some embodiments, the frame may comprise a continuous span of material. In some embodiments, the frame may be substantially a polygon with an empty interior. In some embodiments, the club may have multiple inserts and multiple frames. In some embodiments, the insert comprises an outer insert material and an inner insert material (or a front insert material and a back insert material) with a sandwiched material between the two insert materials. The sandwiched material can be an elastomeric material, a metallic material, or a composite material. The structure of the insert may be a solid plate, a perforated plate, or a cellular structure having walls and voids. The insert may be formed with surface features that improve energy transfer, increase or decrease spin on a ball, or help dissipate vibrations. In embodiments having a cellular structure, the voids of the cellular structure may be varied based upon their location with respect to the targeted hitting area of the face.

In some embodiments, inserts can be joined to a club head using a bonding process. In an embodiment, a frame for receiving a bonded insert will include a recess for receiving a resilient member that directs the bonding material toward the interior of the club head during the bonding process. The resilient member, itself, may include a groove for receiving the insert to assure that the finished club achieves an exterior finish with a smooth surface, and free from excess bonding material. The bonded inserts allow simplified completion of a club head in which other portions of the club have been assembled with other processes. The process allows the interior of the club to be left accessible, e.g., for weight placement, until a final step.

The invention additionally provides a method of making a golf club, including forging an insert to a frame. The forging process may be a cold forging process whereby a hammer or press is brought against the frame with the insert placed inside. In some embodiments, a die is used to shape the insert during the forging process. In some embodiments, the frame, with the insert placed inside, is pressed against a die. The insert and the frame may be constructed from the same material, or the insert and the frame may be constructed from different materials. In some embodiments, the insert is constructed from a combination of materials including both metal and elastomeric materials.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

FIG. 2 differs from FIG. 1 in that the insert is welded to the frame after forging;

FIG. 7 also illustrates that several different materials can be combined into a golf club design;

FIG. 8B illustrates using a pressing element to assemble the surface, thus resulting in a smooth finish. FIG. 8C shows a finished bond between an insert and frame;

DETAILED DESCRIPTION

The invention provides golf club heads, including drivers, hybrids, and irons, having combinations of materials. Typically, the club head includes one or more inserts mechanically coupled to a frame. The insert may comprise a single material, such as titanium, or the inserts may comprise a combination of materials such as a combination of metals, a combination of metal and an elastic material, or a sandwiched structure. The invention additionally provides methods for fabricating a club by incorporating the inserts into a frame, for example by using a cold forging process by which the frame and the insert are mechanically coupled.

Figure 1:
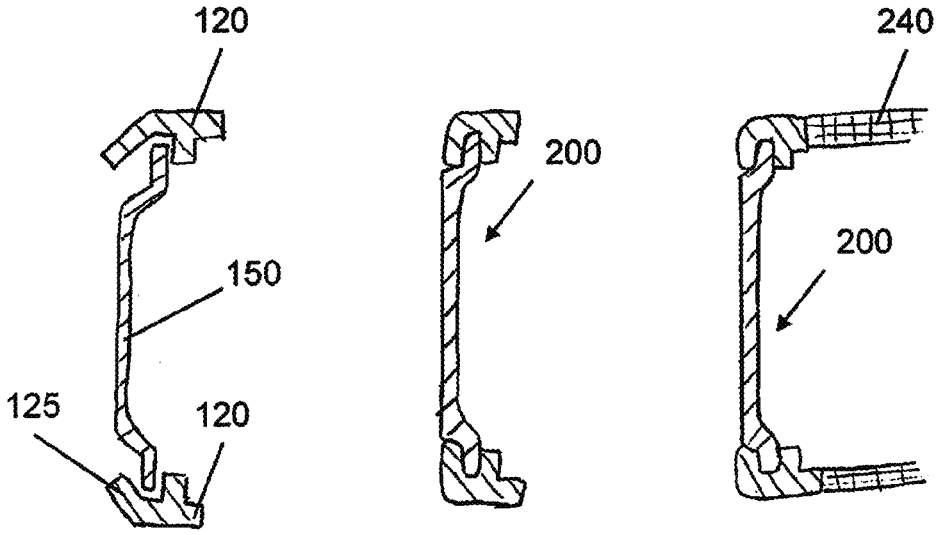
FIG. 1 is a schematic view of a method of making a golf club face by forging an insert to a frame.
Figure 2:
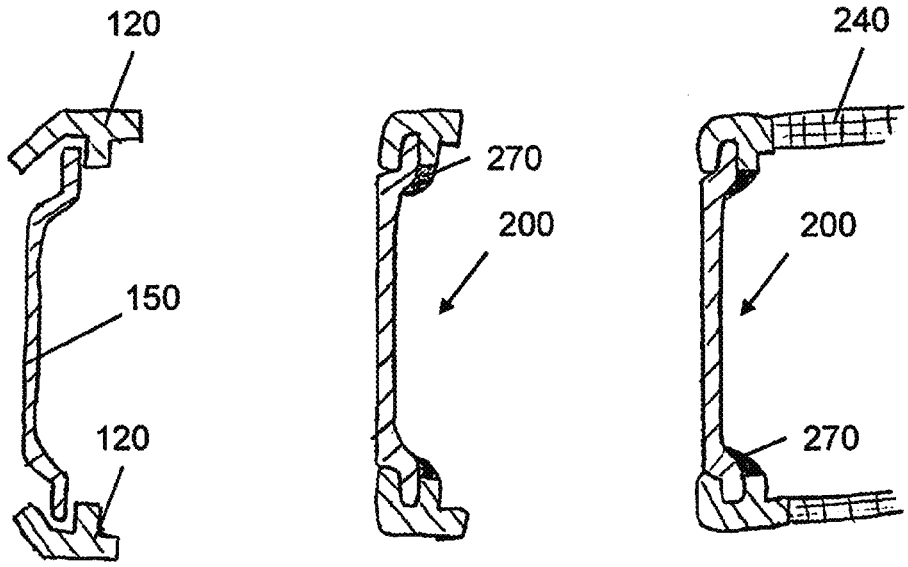
FIG. 2 is a schematic view of a method of making a golf club face by forging an insert to a frame.

Exemplary techniques for mechanically coupling an insert to a frame are shown in FIGS. 1 and 2. The frame is generally a support structure, having tabs or flanges that can be caused to join with an insert or other structural member. FIG. 1 shows a cut-away illustration of a frame 120 being coupled to an insert 150. As shown in FIG. 1, the top and bottom of the frame 120 appear to be disconnected, which they can be, however in some embodiments, the top and bottom of the frame may be joined, for example, because the frame 120 creates a continuous frame, e.g., around the insert. In some embodiments, the frame is constructed with a substantially open interior, as shown in FIGS. 1 and 2.

Figure 15:
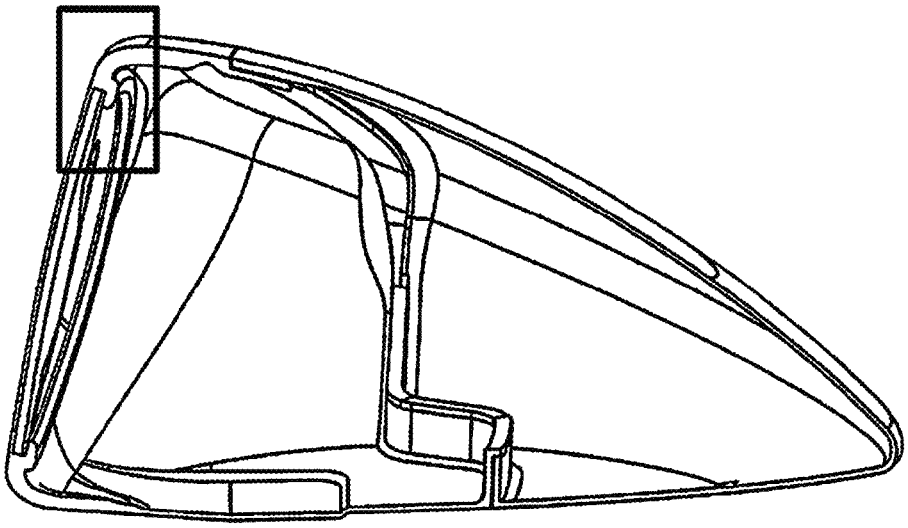
FIG. 15 depicts a club head constructed with a frame having a continuous sheet of material between the frame elements and a two-piece insert.
Figure 16:
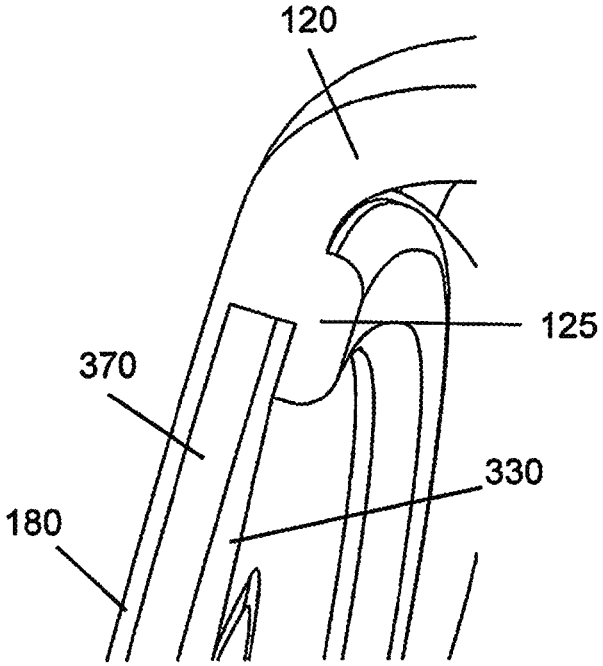
FIG. 16 shows a detailed view of the mechanical coupling of the two-piece insert of FIG. 15.

In other embodiments, e.g., FIGS. 15 and 16, the frame may comprise a continuous piece of material between the frame elements. The continuous piece of material may assist in fabrication of the frame because it allows material to flow across the piece, e.g., when casting a frame. The continuous piece may help to maintain the dimensions of the frame during production, e.g. to avoid deformation. The continuous piece may also act a surface of the club (e.g., a face, or sole, or crown, etc.) and/or provide the look of a continuous uninterrupted piece of material.

The frame 120 will typically comprise a plurality of tabs 125 (flanges) that will be deformed during the mechanical coupling process to couple the frame 120 to the insert 150. The insert can be of a continuous thickness, as show in the FIGS. 1-4, or the insert 150 can be of variable thickness, or including interior surface features, such as ribs. In an embodiment, the insert 150 can be 5 mm or less in thickness, e.g., 4 mm or less in thickness, e.g., 3 mm or less in thickness, e.g., 2 mm or less in thickness, e.g., 1 mm or less in thickness.

In an embodiment, the frame 120 and the insert 150 are joined with a forging process. Forging typically involves bringing a weight down onto a malleable work piece to cause the shape, size, or condition of the work piece to be changed. The weight may be free-falling (e.g., a hammer) or the weight can be pressed against the piece using hydraulics or pneumatics (e.g., a press). In some instances, the piece is pressed against a die that has the desired shape. (A process alternatively referred to as swaging.) The forging may be done at a temperature greater than the recrystallization temperature of the work piece material (hot forging) or the forging can be done at a temperature below the recrystallization temperature of the work piece material (cold forging). Hot forging requires elevated temperatures and special equipment because the recrystallization temperature of even low-temperature materials, such as aluminum, is at least about 250° C. Cold forging is done below the crystallization temperature of the work piece material, typically room-temperature, but can result in brittleness because cold forging sets the grain pattern of the work piece material. This "work-hardening" process makes post-forging processes (grinding, cutting, etc.) more difficult, and can result in undesired mechanical properties in the final product.

In an embodiment, the insert 150 and the frame 120 are joined with a cold forging process. The process involves assembling the insert 150 into the frame 120, placing the assembly into a die, and then pressing the pieces against a die with a hydraulic press, thereby causing the insert 150 and the frame 120 to become mechanically coupled. The resulting coupled assembly 200 is shown in the middle of FIG. 1. The boundary lines between the insert 150 and the frame 120 are exaggerated in FIGS. 1-4, however, because the forging process results in a coupled assembly 200 that appears to be a continuous piece of metal except for a parting line. The parting line, in some cases, can be incorporated into score lines of the insert, e.g., a face insert, to hide the parting line. Other differences, e.g., differences in sheen, can be accentuated or hidden with surface treatments, such as grinding or sandblasting.

Figure 5:
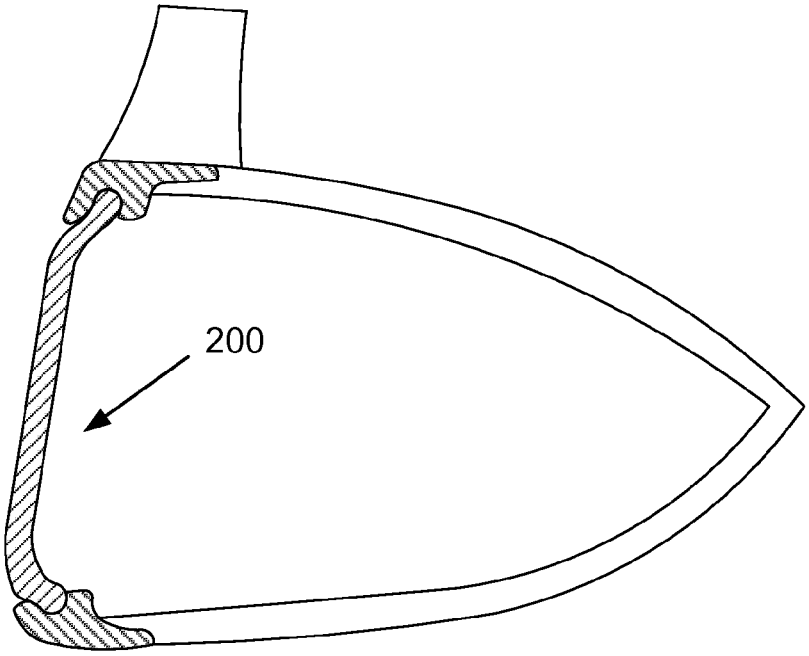
FIG. 5 shows a cross-sectional view of a driver-type or hybrid-type golf club head with a face comprising a face insert that has been mechanically coupled to a frame with a forging process.
Figure 6:
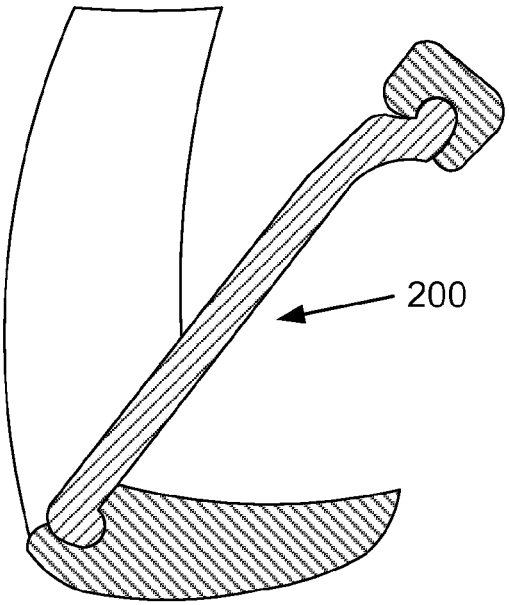
FIG. 6 shows a cross-sectional view of an iron-type golf club head with a face comprising a face insert that has been mechanically coupled to a frame with a forging process.

In the case of a driver or hybrid, once the coupled assembly 200 has been formed, the coupled assembly 200 can be joined to the body of the driver 240. In one embodiment, the insert is a face insert, and the body comprises a crown and a sole, and optionally a skirt. In another embodiment, the insert is a sole insert, and the body comprises a face and a crown, and optionally a skirt. In an embodiment, the frame 120, the insert 150, and the body of the driver 240 can be formed from different materials. In general, the frame 120, the insert 150, and the body of the driver 240 are constructed from aluminum, aluminum alloys, steel, titanium, titanium alloys, tungsten, tungsten alloys, magnesium, magnesium alloys, beryllium, beryllium alloys, copper, copper alloys, composite, or polymer. The coupled assembly 200 can be joined to the body of the driver 240 using any known method, including fasteners (e.g., screws or clips), adhesives (e.g., epoxy or glue), welding, or by using hot or cold mechanical binding (e.g., forging or crimping). In an embodiment, the coupled assembly 200 can form a face cup that fits onto a mating surface of the body of the driver 240, as shown in FIG. 5. In the case of an iron, the frame 120 may be integrated into the body of the club head as shown in greater detail in FIGS. 6 and 10.

In some embodiments, it may be beneficial to additionally weld or bond the insert 150 and the frame 120 together, as shown in FIG. 2. In the embodiment shown in FIG. 2, a weld bead 270 is formed around a perimeter of the frame 120 to provide additional reinforcement of the joint. A weld bead 270 would be placed after the forging process is completed. As shown in FIG. 2, the weld bead 270 is preferentially placed on an interior surface of the coupled assembly 200 so that it is hidden from view. A weld bead 270 could also be placed on a front surface of the coupled assembly 200, as needed, or required for ease of manufacture. For example when fabricating an iron-type face it may be easier to place the weld bead 270 on the front and then grind the surface smooth to hide the bead. In some embodiments, a series of small welds "spot welds" will be placed around the perimeter of the frame 120. Other techniques, such as bonding, can also be used to reinforce the coupled assembly 200.

Figure 3:
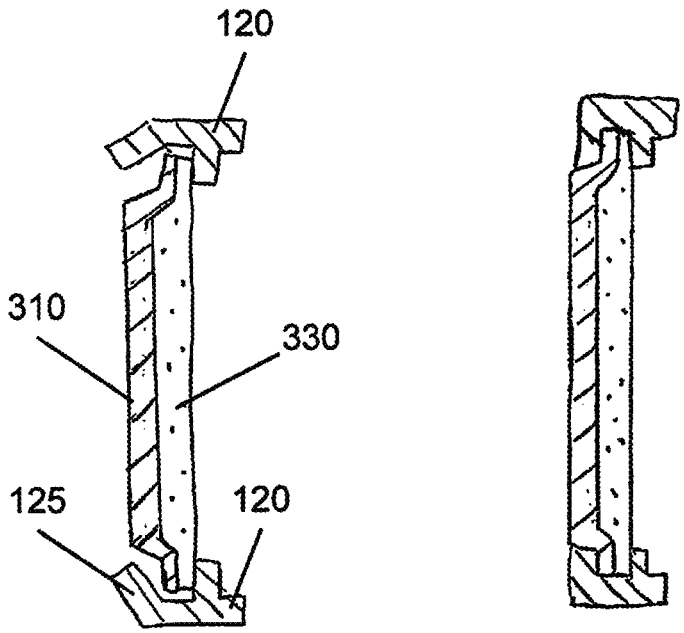
FIG. 3 is a schematic view of a method of making a golf club face by forging an insert to a frame, wherein the insert comprises an inner and outer insert material.
Figure 4:
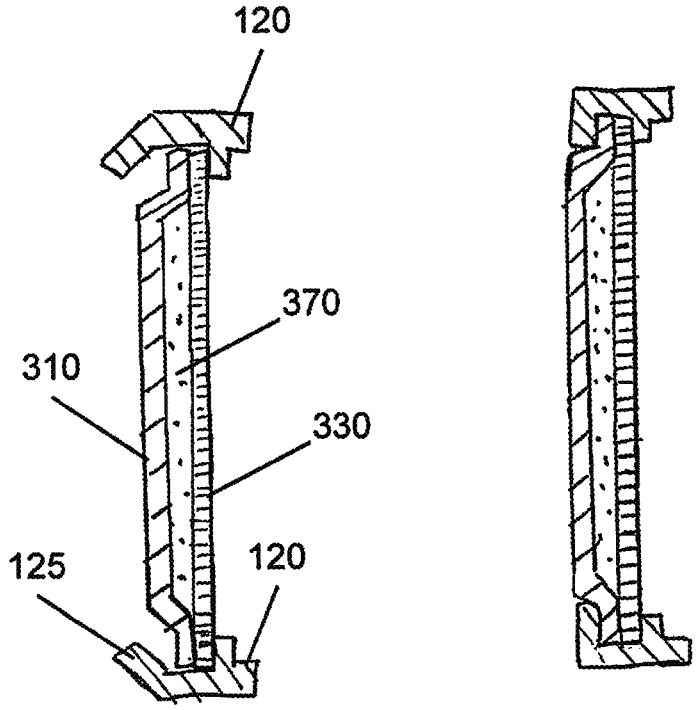
FIG. 4 is a schematic view of a method of making a portion of a golf club by forging an insert to a frame, wherein the insert comprises an inner and outer insert material and a sandwiched material between the inner and outer insert material.

In addition to allowing disparate materials to be joined together, e.g., the insert 150 and the frame, the described techniques facilitate incorporation of multiple materials into the insert 150 itself, as shown in FIGS. 3 and 4. In an embodiment shown in FIG. 3, the insert 150 may be constructed from an outer insert material 310 and an inner insert material 330. (The corresponding outer insert material 310 is referred to as a "front insert material" in the described iron-type club head construction, while the corresponding inner insert material 330 is referred to as a "back insert material" in the described iron-type club head construction.) The outer insert material 310 may be of a continuous thickness, as show in FIGS. 3-4, or the outer insert material 310 can be of variable thickness. In an embodiment, the outer insert material 310 can be 5 mm or less in thickness, e.g., 4 mm or less in thickness, e.g., 3 mm or less in thickness, e.g., 2 mm or less in thickness, e.g., 1 mm or less in thickness. The inner insert material 330 may be of a continuous thickness, as show in FIGS. 3-4, or the inner insert material 330 can be of variable thickness. In an embodiment, the inner insert material 330 can be 5 mm or less in thickness, e.g., 4 mm or less in thickness, e.g., 3 mm or less in thickness, e.g., 2 mm or less in thickness, e.g., 1 mm or less in thickness. In some embodiments, the outer insert material 310 and the inner insert material 330 may have complimentary shapes, such as adjacent wedge shapes.

The outer insert material 310 is typically a metal, however, it could also be constructed from a composite or high-strength polymer. The inner insert material 330 could also be a metal, composite, or high-strength polymer, however the inner insert material 330 may alternatively be a elastomeric material such as rubber or a polymer comprising butadiene. In general, the outer insert material 310 and the inner insert material 330 can be selected from aluminum, steel, titanium, tungsten, magnesium, beryllium, copper, composite, and polymer. The inner insert material 330 may alternatively include materials such as lead or depleted uranium to affect the weight distribution. The inner insert material 330 may comprise woven materials with high elasticity, such as synthetic spider silk. Alloys or combinations of any of the previously-mentioned materials may also be suitable for use in forming a face assembly. The inner insert material 330 need not be a continuous sheet of material. For example, the inner insert material 330 may have holes or comprise a screen-like structure. The inner insert material 330 may also comprise structures that will be internal to the club head, such as ribs, or cross-hatching.

As shown in FIG. 4, the insert 150 may alternatively comprise an outer insert material 310, an inner insert material 330, and a sandwiched material 370. The outer insert material 310, the inner insert material 330, and sandwiched material 370 can be selected from any of the materials described above with respect to FIG. 3. In some embodiments, the sandwiched material 370 is an extremely light-weight construct that provides excellent lateral stiffness, such as a honeycomb or tubular structure. The sandwiched material 370 may also include a cellular structure with a variable distribution of voids, as shown in FIGS. 7-11. In some embodiments the sandwiched material may comprise a metal construct, such as an aluminum cellular structure. In other embodiments, the sandwiched material 370 may be constructed from materials such as spring steel, carbon fiber, or buckypaper. The designs of the invention are not limited to a total of three materials, as the sandwiched material 370 could comprise multiple materials or layers of the same materials.

Other materials that can be used for the sandwiched material 370 include elastomeric materials, such as elastomers, vinyl copolymers with or without inorganic fillers, polyvinyl acetate with or without mineral fillers such as barium sulfate, acrylics, polyesters, polyurethanes, polyethers, polyamides, polybutadienes, polystyrenes, polyisoprenes, polyethylenes, polyolefins, styrene/isoprene block copolymers, metallized polyesters, metallized acrylics, epoxies, epoxy and graphite composites, natural and synthetic rubbers, piezoelectric ceramics, thermoset and thermoplastic rubbers, foamed polymers, ionomers, low-density fiber glass, and mixtures thereof. The metallized polyesters and acrylics preferably comprise aluminum as the metal. Piezoelectric ceramics particularly allow for specific vibration frequencies to be targeted and selectively damped electronically. Commercially available materials applicable for the present invention include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFleX™ Sylomer® from Pole Star Maritime Group, LLC, and Legetolex™ from Piqua Technologies, Inc.

In other embodiments, sandwiched material 370 may be selected from materials such as plastic polymer, aluminum polymer, foam, resin impregnated paper, balsa wood, bucky paper, filled vinyl polymer, elastomeric polymers, viscoelastic polymers, rubber, or any type or material that is of a low density and has substantial compressibility such that it can withstand the manufacturing process without collapsing. Sandwiched material 370 could also be in various different shapes such as a honeycomb hexagonal shape, trapezoidal shape, triangular shape, pyramidal shape, conic shape, cylindrical shape, spherical shape, rhombus shape, or any other shape that is capable of providing increased structural stiffness while minimizing density and weight of the golf club head. In other embodiments, sandwiched material 370 may also be a dense heavy material that allows specific weights to be placed at various locations of golf club head without the need for alternative attachment mechanisms. In other embodiments, sandwiched material 370 may additionally or alternatively serve a vibration-damping purpose. For example, sandwiched material 370 could be of a foam type material, cotton type material, or any other material capable of absorbing vibration damping.

In an alternative embodiment, the sandwiched material 370 may comprise a fluid, such as a gas or a liquid. The trapped fluid may be independently sealed between the outer insert material 310 and the inner insert material 330 by welding or bonding the outer insert material 310 and the inner insert material 330 together to form a pocket. Alternatively, the trapped fluid may be encased in a bladder or other container prior to being placed between the outer insert material 310 and the inner insert material 330. In some embodiments, the sandwiched material can comprise a cellular structure, such as shown in FIGS. 8-12, wherein the voids are filled with a fluid, e.g., a gas. In some embodiments, the fluid may be at a pressure greater than atmospheric pressure.

In some embodiments, the insert will be a face insert. The face insert may be comprised of a single material, or the face insert may comprise layered or sandwiched materials, as described above. One benefit of the described face construction, including the layered face construction, is the ability to achieve exceptional Coefficients of Restitution (COR) during impact while at the same time removing weight from the face insert structure. In the field of golf clubs, the COR is used to compare the effectiveness of a club head at imparting kinetic energy to a ball. The COR is measured with respect to a standardized golf ball, and represents the ratio of kinetic energy of the objects before and after they collide. Because of conservation of energy, the losses in kinetic energy must be due to losses such as deformation of the ball and vibration of the club head. If the impact is perfectly elastic, i.e., no kinetic energy is lost, the COR is 1.0. If all kinetic energy is lost, the COR is zero. USGA regulations limit compliant clubs to a COR of 0.83, however, there are few clubs currently available with a COR of 0.83 or greater. Using the designs and methods described herein, it is possible to achieve a COR greater than 0.83, e.g., greater than 0.85, e.g., greater than 0.87.

Using the designs and methods described, it is possible to fabricate a variety of different types of club heads with a coupled assembly 200 comprising an insert 150 and a frame 120. Such clubs may comprise the same or different materials. For example, the club head could be a driver-type or hybrid-type club head as shown in FIG. 5, or an iron-type club shown in FIG. 6. While not exemplified with a figure, it is to be understood that the same techniques and designs can be used to form a putter-type club head with an insert 150 and a frame 120. Of course, any of these clubs can be formed with a multi-component construction. Club heads according to the invention may be any of a variety of known shapes, sizes, and type, including drivers, fairway woods, hybrids, irons, wedges, and putters.

A golf club head of the invention may have a volume ranging from approximately 150 cubic centimeters to approximately 600 cubic centimeters, and more preferably in the volume range of approximately 350 cubic centimeters to approximately 550 cubic centimeters, even more preferably in the volume range of approximately 375 cubic centimeters to approximately 475 cubic centimeters, and most preferably approximately 420 cubic centimeters to approximately 460 cubic centimeters; all without departing from the scope of the present invention.

The mass of a golf club head of the invention ranges from 165 grams to 250 grams, preferably ranges from 175 grams to 230 grams, and more preferably from 190 grams to 210 grams. Insert 150 may have a weight of approximately 20 grams to approximately 60 grams, preferably ranging from approximately 30 grams to approximately 50 grams, and more preferably from approximately 35 grams to approximately 45 grams. A body section of the club head may have a weight of approximately 115 grams to approximately 145 grams, preferably ranging from approximately 120 grams to approximately 140 grams, and more preferably from approximately 125 grams to approximately 135 grams.

Golf club heads may have a preferred length range of approximately 1.5 inches to 5.0 inches measuring from the face of the club towards the back of the club in accordance with USGA definitions; more preferably 3.0 inches to 5.0 inches, and most preferably 4.0 inches to 5.0 inches. Additionally, a golf club head may have a preferred width range of approximately 3.0 inches to 5.0 inches measuring from the widest part of the heel to the widest part of the sole in accordance with USGA definitions; more preferably 4.0 inches to 5.0 inches.

In an embodiment shown in FIG. 5, the invention is a club head including a crown section, a sole section, and a face insert. In alternative embodiments, the body of a driver could contain various other components such as a skirt section, a toe section, a heel section, or any other section not defined as a hitting face without departing from the scope of the present invention. In order to maintain the large volume of the club head, while providing maximum discretionary mass, the crown section and the sole section will typically have thin walls, e.g., formed of thin metal or composite. The crown section and sole section may be spaced apart from each other, and then combined to form the body section with or without any further subcomponents such as a skirt section, a toe section, and a heel section, all without departing from the scope of the present invention. In an embodiment, the crown and the sole are bonded or welded together to form a body and then a coupled assembly is joined to the body. Typically, the head will also include a hosel, providing a transition between a club shaft and the club head. The hosel may joined to the frame, e.g., a face frame, or the body, or both. The hosel may be adjustable, in that it allows the shaft to be repeatably unsecured from the club head, rotated, and then resecured in a new position. Typically, adjusting the hosel will require a special tool, such as an Allen key or a TORX-type driver.

A golf club head according to the invention may also comprise one or more weight members that allow the center of mass of the club head to be varied. In some embodiments, the weights will be fixed, e.g., to the sole of a driver club head body. In other embodiments, the weights may be removable, replaceable, or adjustable. The weights may be rotationally adjustable, or the weights may be slideably adjustable, e.g., within a slot. In some instances the weights may be reversibly coupled to the club head body, allowing a user to remove, replace, or move the weight to change the weight distribution of the club head.

Figure 7:
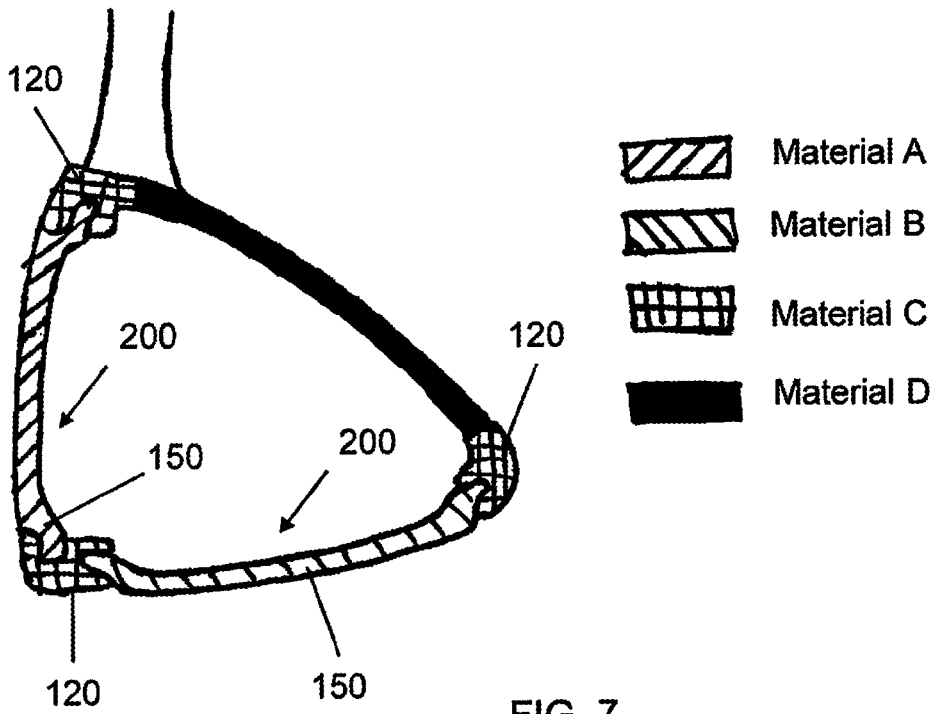
FIG. 7 shows a cross-sectional view of a driver-type or hybrid-type golf club head with a face comprising a face insert that has been mechanically coupled to a frame with a forging process and a sole comprising a sole insert that has been mechanically coupled to a sole frame with a forging process.

Using the described techniques for mechanically joining materials, it is possible to create a club head having several different materials, e.g., as shown in FIG. 7. The club head of FIG. 7 includes inserts 150 and frame 120 that are mechanically coupled to produce coupled assemblies 200, i.e., a face and a sole. Each element of the club head, e.g., the frame(s) 120 and the inserts 150 can be constructed from a different material. As shown in FIG. 7, both the face insert and the sole insert have been mechanically coupled to the frame, e.g., with forging, while the crown has been bonded to the frame. In other embodiments, different portions of the club head may be mechanically coupled, such as the face and the crown, or the sole and the crown, or the face, and the sole, and the crown. Other methods of constructing the club can be used. A club head, such as shown in FIG. 7, may include materials such as aluminum, aluminum alloys, steel, titanium, titanium alloys, tungsten, tungsten alloys, magnesium, magnesium alloys, beryllium, beryllium alloys, copper, copper alloys, composite, or polymers.

FIG. 8 shows an alternative method of coupling an insert to a frame, using a bonding material 440, for example a glue or an epoxy, in conjunction with a resilient member 420. Like the mechanical coupling described above, the bonding coupling of FIG. 8 includes a frame 120 and an insert 150. However, the bonding coupling does not use mechanical joining with forging or swaging, but rather depends upon a chemical bond between the frame 120 and insert 150. The bonding coupling shown in FIG. 8 can be used in addition to the mechanical coupling described in FIGS. 1-7 to achieve a complete club head, e.g., as shown in FIG. 9. In some embodiments, the bonding coupling will be used to complete a club in which multiple inserts have been coupled to one or more frames using forging. In such embodiments, the crown insert may be bonded to the frame while the face insert and the sole insert are coupled to a frame with forging.

As shown in FIG. 8, one embodiment of a bonding coupling includes a frame 120 having a recess 123 for receiving a resilient member 420 and a lip 127 that provides a surface for receiving a bonding material 440 and an interior surface of the insert 150. In the embodiment shown in FIG. 8, the resilient member 420 is constructed with a groove that couples to the interior surface of the insert 150 and maintains the interior surface of the insert 150 at a predetermined distance from the lip 127. The predetermined distance is established by the size of the groove and the material from which the resilient member 420 is constructed. In some embodiments, the predetermined distance is between about 1.0 mm and 0.1 mm, e.g., between about 0.5 mm and about 0.2 mm, e.g., about 0.3 mm. The resilient member may be constructed from rubber, polybutadiene, or another known resilient material. In some embodiments, the resilient member 420 may extend around a circumference of the frame. In some embodiments, the resilient member 420 may extend for a portion of the frame. In some embodiments, the resilient member 420 may span multiple frames. In some embodiments, the resilient member 420 is a gasket.

Figure 8A:
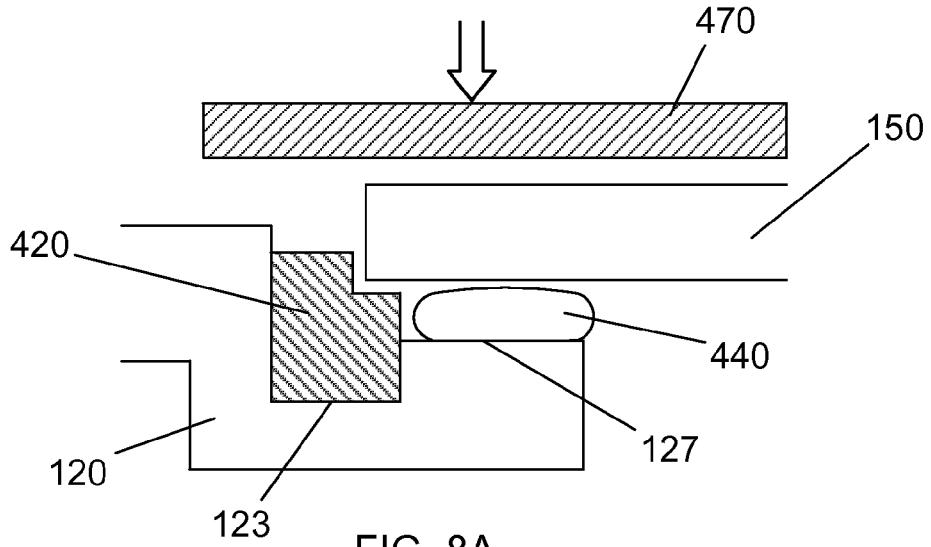
FIGS. 8A-C exemplify an alternative method for coupling an insert to a frame. In the embodiment shown in FIG. 8A, a resilient member is used to maintain a seal to the insert and to direct the bonding material (i.e., glue) inward.
Figure 8B:
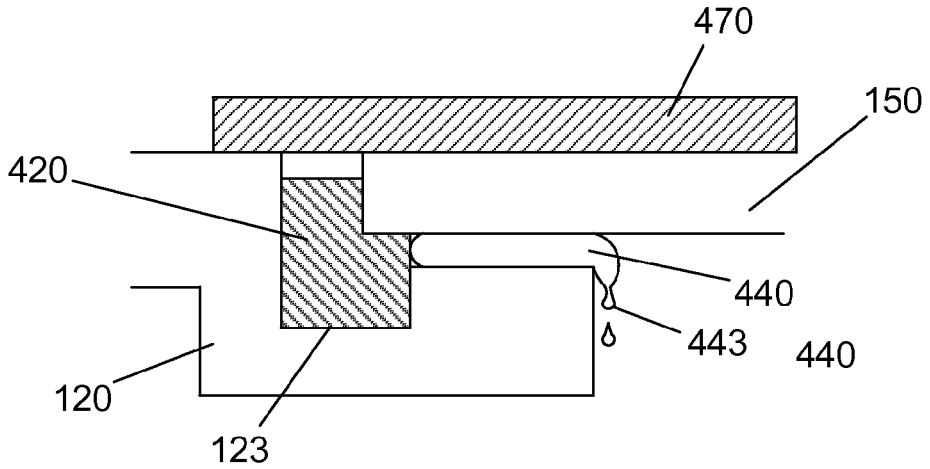

FIG. 8 also details a method of coupling an insert to a golf club head. A pressing member 470 which can be curved or substantially straight is presented to the frame 120, with a resilient member 420 coupled thereto, and an insert 150. As shown in FIG. 8A, the pressing member 470 is moved against the frame 120 and the insert 150, however, the frame 120 and the insert 150 could also be moved against a pressing member 470. The pressing member 470 may be part of a die used to construct the club head. In addition to bringing the frame 120 and the insert together, the pressing member 470 may provide a force to cause other inserts 150 (not shown) to be mechanically coupled to a frame 120 (not shown), e.g., as described in FIG. 1. Pressure exerted on the insert 150 with the pressing member 470 causes a portion of the bonding material 420, shown as bonding material excess 443, to leave the space between the insert 150 and the lip 127, as shown in FIG. 8B. Because of the shape and placement of the resilient member 470, the bonding material excess 443 is directed toward the interior of the club head, so that the bonding material 420 does not disturb the exterior of the club head. Furthermore, this construction assures that bonding material 420 does not touch the pressing member 470, which could cause the pressing member 470 to bond to the insert 150, or transfer bonding material 420 or accumulated dirt onto a subsequently assembled club head.

Figure 8C:
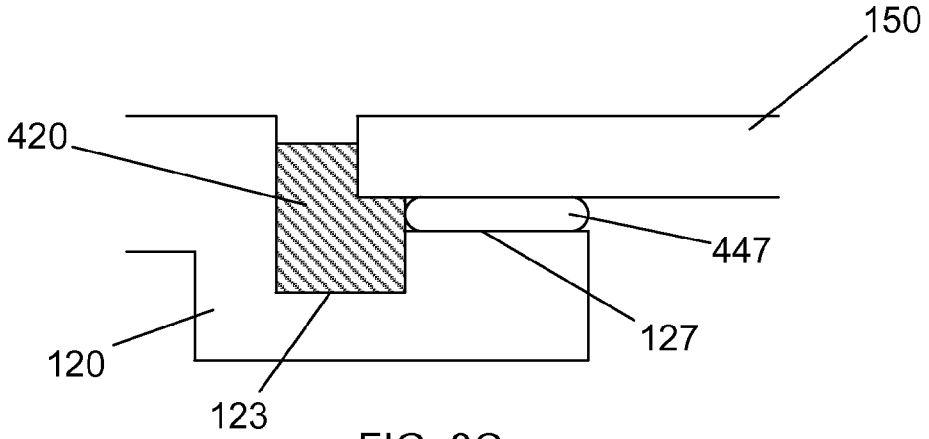
Figure 9:
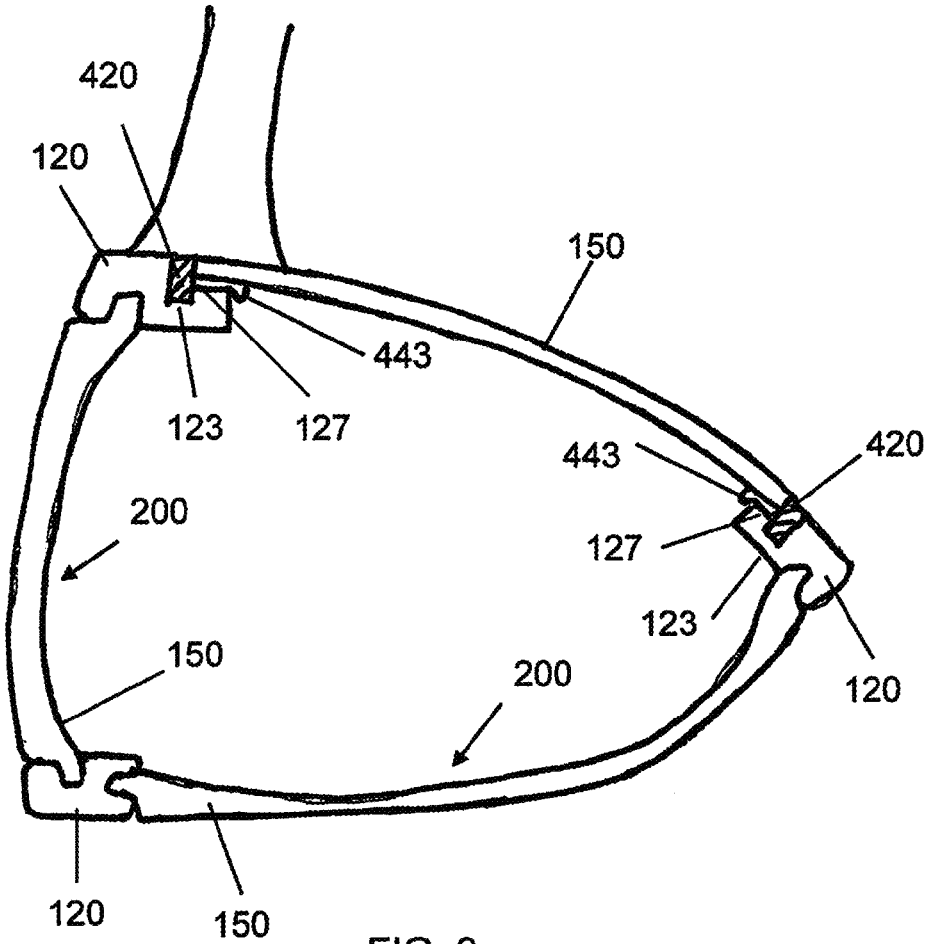
FIG. 9 shows a cross-sectional view of a driver-type or hybrid-type golf club head with a face comprising a face insert that has been mechanically coupled to a frame with a forging process, a sole comprising a sole insert that has been mechanically coupled to a frame with a forging process, and a crown bonded to a frame with a gasket member and bonding material (e.g., glue). The frames may be used to mechanically couple multiple elements. For example, a portion of a frame may serve the role as face frame and sole frame.

The finished assembly, shown in FIG. 8C, comprises a frame 120, resilient member 420, and insert 150 bonded to the lip 127 with cured bonding material 447. In addition to preventing bonding material 440 from being squeezed onto the exterior of the club head, the resilient member 420 in the finished assembly additionally assures that fluids, e.g., gasses and liquids, e.g., water, cannot enter the interior of the club head, where the fluids could alter the weight or sound of the club head, or cause corrosion. In most embodiments, the resilient member 420 will provide a fluid-tight seal over a range of temperatures, e.g., from about −20° C. to about 50° C. The resilient member 420 will also provide a shock-resistant seal to assure that fluids cannot enter the club head interior through microcracks that may form in cured bonding material 447 after repeated strikes between the club head and a ball. Such a temperature- and shock-resistant seal will improve the look and performance of the club head over the life of the club.

FIG. 9 illustrates a completed club head having two inserts (face and sole) mechanically coupled to frames, as described in FIGS. 1 and 2 and the accompanying text, and a bonded insert (crown), as described above with respect to FIGS. 8A-8C. The club head shown in FIG. 9 is exemplary of clubs that can be formed in a similar fashion, and need not be limited to this configuration. For example, a club head could include multiple inserts that are bonded to a frame. A club head could include mechanically-coupled or bonded inserts having sandwiched insert designs, discussed below. A club head may include a portion of the club head, e.g., a face, a sole, a crown, a skirt, a top, or a bottom that includes both mechanically-coupled and bonded inserts. In some embodiments, the club of FIG. 9 is formed with a multi-step process including forging and bonding. In some embodiments, the club of FIG. 9 is formed in a single process in which multiple inserts are mechanically coupled to the frame(s) at the same time that an insert is bonded to the frame. The inserts and frames may be constructed from any of the materials discussed above. The inserts and frames may be constructed from different materials, or the inserts and frames may be constructed from the same materials.

Figure 10:
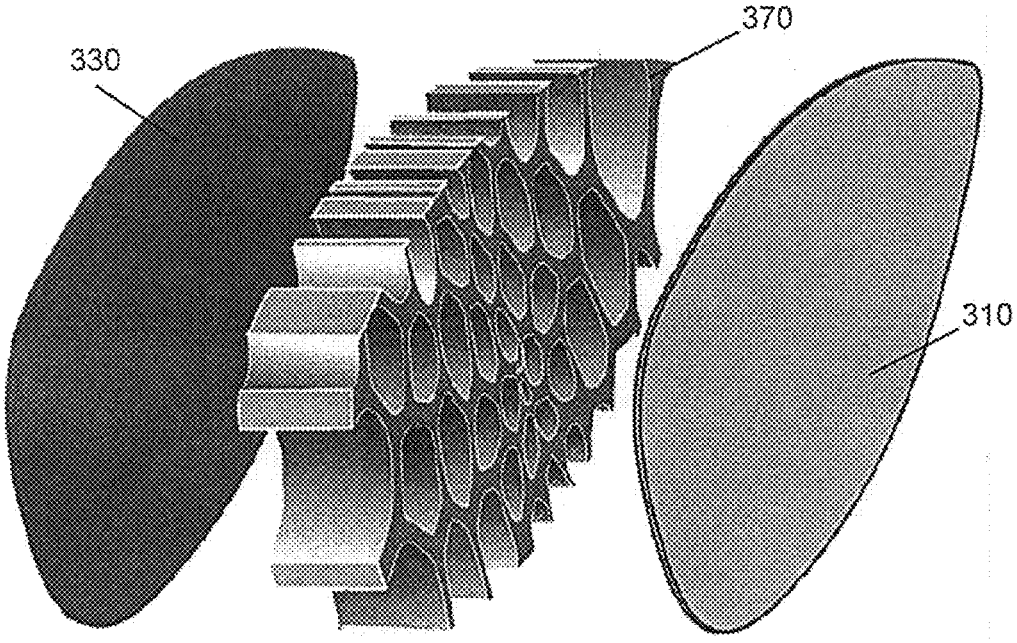
FIG. 10 is an exploded view of inner and outer insert materials and a sandwiched material comprising a plurality of voids, where the voids are smaller in size toward the center of the insert, e.g., a face insert.

In all of the embodiments discussed above, an insert 150 may comprise a multilayer insert. For example, in some embodiments, the insert 150 will include an outer insert material 310, an inner insert material 330, and a sandwiched material 370 having a cellular structure as depicted in FIGS. 10-14. In an embodiment, the cellular structure is primarily open, having a plurality of voids between walls. While the structure is similar, in some senses, to a honeycomb structure, the cellular structure is more efficient in bearing the needed loads with the minimum amount of material. Toward the center of the cellular structure, e.g., as shown in FIGS. 10 and 12, the voids are smaller resulting in a greater mechanical stiffness and durability. Toward the exterior of the cellular structure, the voids are larger, providing only the needed mechanical stability while helping to distribute loads across the surface area of insert 150 with minimum material (and also minimum weight). The distribution and size of the cells can be modeled, and in some club sets the distribution of cells will vary along a set of clubs. For example, long irons may have a concentration of small voids in the center with larger voids at the periphery, while short irons may have a more regular distribution of the cell sizes across the insert. A multi-layer insert may be constructed from any combination of materials disclosed herein. For example, the insert may be a Ti—Al—Ti construction, a Ti—Al—Ti construction, a Ti—Mg—Ti construction, or simply a Al—Ti, or Al—Mg, or Ti—Mg construction.

Figure 11:
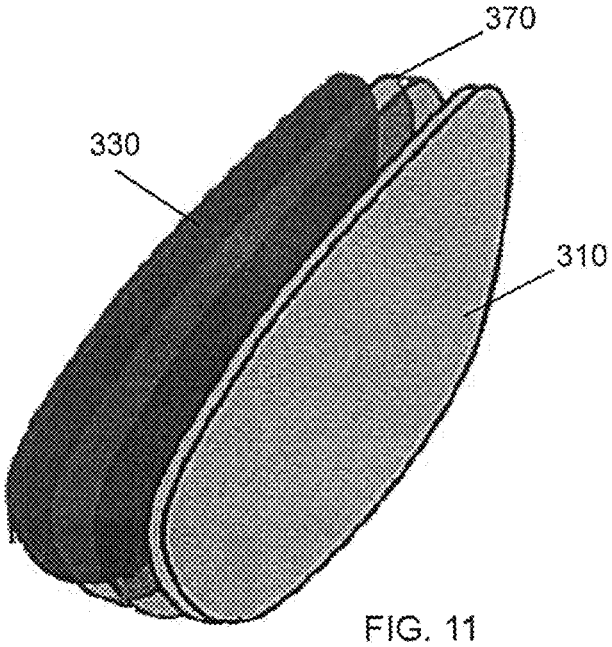
FIG. 11 depicts partial assembly of the exploded components of FIG. 10.
Figure 12:
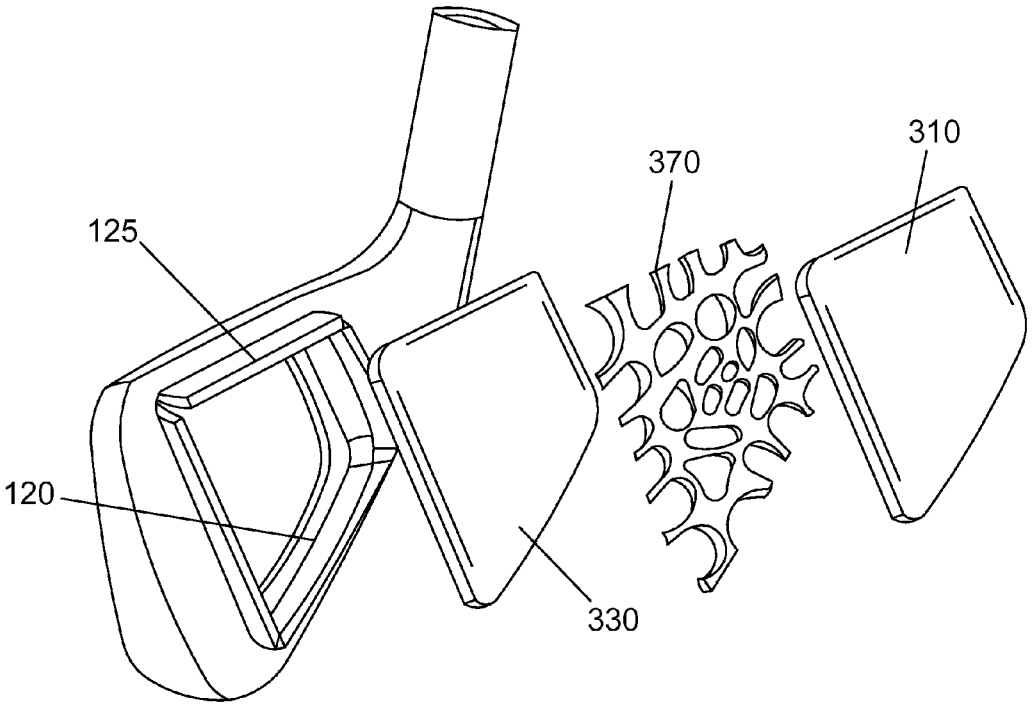
FIG. 12 is an exploded view illustrating the construction of a golf club head comprising a frame and a face insert. The face insert includes front and back insert materials and a sandwiched material comprising a plurality of voids, where the voids are smaller in size toward the center of the face.
Figure 13:
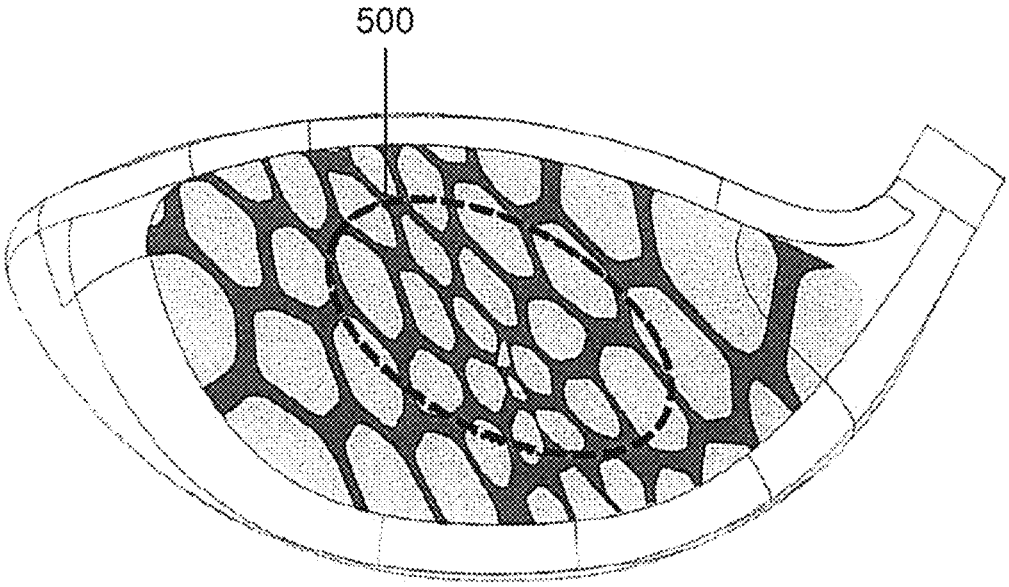
FIG. 13 depicts a driver having a face insert comprising a cellular structure wherein the outer face material has been removed to show that the voids are smaller in the targeted striking area of the face (dashed oval)

As shown in FIGS. 10 and 11, an insert 150 includes an outer insert material 310, an inner insert material 330, and a sandwiched material 370, may be placed together and then mechanically coupled to a frame 120, e.g., using the forging methods described above. In particular, the insert 150 of FIGS. 10 and 11 is intended to be coupled to a frame 120 to create a coupled assembly 200 to be coupled to a driver head, e.g., shown in FIG. 5. If viewed face-on (through the outer insert material 310) the cellular structure would appear as shown in FIG. 13. Note that the concentration of smaller voids corresponds to the targeted impact area 500. In some embodiments, a cellular insert will comprise outer insert materials 310 and inner insert materials 330 made from titanium or a titanium alloy. The sandwiched material 370 of the cellular design may be formed from aluminum or an aluminum alloy. In alternative embodiments, the cellular insert will comprise outer insert materials 310 and inner insert materials 330 made from aluminum or an aluminum alloy. In alternative embodiments, the cellular insert will comprise outer insert materials 310 and inner insert materials 330 made from magnesium or a magnesium alloy. The sandwiched material 370 of the alternate cellular design may be formed from titanium or a titanium alloy. Other materials of construction may be suitably chosen from the lists of materials described above. For example, the insert may be a Ti—Al—Ti construction, a Ti—Al—Ti construction, a Ti—Mg—Ti construction, or simply a Al—Ti, or Al—Mg, or Ti—Mg construction.

Other variations on the sandwiched insert design are also feasible. For example, the frame could be constructed with an integral element that will become part of the insert. In this embodiment, a frame, including, e.g., a face, can be cast having tabs 125 that allow additional insert pieced to be mechanically coupled to the face, thereby creating a layered or sandwiched design. In other embodiments, the frame could include an integral member having a pocket into which one or more interior insert materials can be added, prior to the pocket being sealed. In one embodiment, the frame will comprise a thin aluminum member, e.g., thin aluminum face, and a magnesium layer and a titanium layer will be placed atop the thin aluminum member and the entire assembly mechanically coupled with a forging process. In some embodiments, adhesives or other additives may be added between the layers to change the mechanical properties of the club or to increase the longevity of the club.

Figure 14:
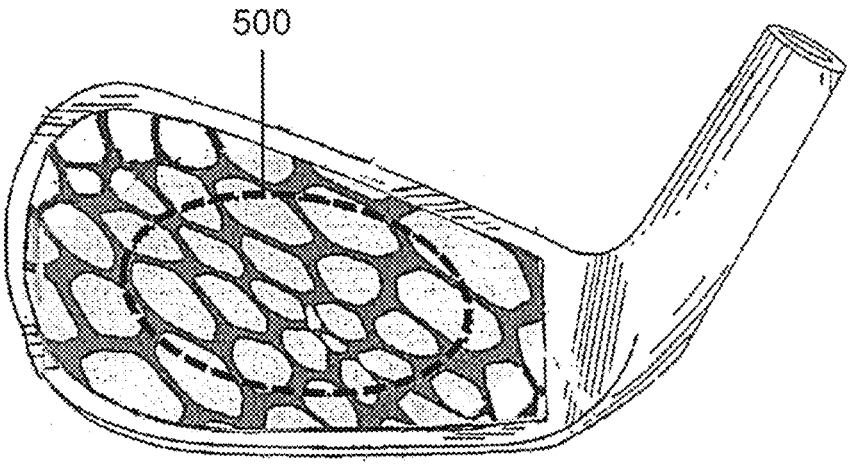
FIG. 14 depicts an iron having a face insert comprising a cellular structure wherein the front insert material has been removed to show that the voids are smaller in the targeted striking area of the face (dashed oval).

A method for fabricating an iron-type golf club having a cellular sandwiched material is shown in FIG. 12. Like FIGS. 10 and 11, an insert 150 includes an outer insert material 310, an inner insert material 330, and a sandwiched material 370. The outer and inner insert materials and the sandwiched materials may be placed together and then mechanically coupled to a frame 120, e.g., using the forging methods described above. In the embodiment shown in FIG. 12, the frame 120 is an integral part of the body of the iron-type club head. Using the methods described above, the tab 125 portion of the frame is coupled to the insert 150, providing a rigid structure. If viewed face-on (through the outer insert material 310) the cellular structure would appear as shown in FIG. 14. Note that the concentration of smaller voids corresponds to the targeted impact area 500. Like the driver/hybrid construction, in some embodiments a cellular insert of an iron-type club head will comprise outer insert materials 310 and inner insert materials 330 made from titanium or a titanium alloy. The sandwiched material 370 of the cellular design may be formed from aluminum or an aluminum alloy. In alternative embodiments, the cellular insert will comprise outer insert materials 310 and inner insert materials 330 made from aluminum or an aluminum alloy. The sandwiched material 370 of the alternate cellular design may be formed from titanium or a titanium alloy. Other materials of construction may be suitably chosen from the lists of materials described above.

An alternative embodiment, having a continuous piece 180 running between the frame 120 on different sides of the face, is shown in FIGS. 15 and 16. As discussed above, the continuous piece 180 can serve a variety of functions, including club performance and frame alignment. FIG. 15 shows a cut-away of a driver-type golf club having a frame with a continuous piece 180 as well as a detailed view of the mechanical coupling, shown in FIG. 16. As shown in FIGS. 15 and 16, the insert includes inner insert material 330 and sandwiched material 370. However other configurations are possible, such as a single insert or a structured sandwich insert or any other combination taught herein. The continuous piece 180 need not be on the exterior of the club, however, as it could be formed as an inner surface, or a sandwiched material. The continuous piece 180 may be constructed from any material discussed herein, such as aluminum and aluminum alloys or titanium and titanium alloys. The continuous piece 180 is typically 0.5 mm or thinner in the center of the piece, e.g., 0.4 mm or thinner, e.g., 0.3 mm or thinner, e.g., 0.2 mm or thinner, e.g., about 0.1 mm.

Thus, the invention discloses golf club heads having an insert mechanically coupled to a frame and methods of making the structures. In some embodiments, the insert comprises a sandwiched material, such as a cellular structure. It should be understood, of course, that the foregoing relates to exemplary embodiments of the invention and that modifications may be made without departing from the scope and content of the invention as set forth in the following claims.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

The invention claimed is:

1. A golf club head comprising:

a body, including a top line, a sole, and a frame; and a face insert mechanically coupled to the frame with a forging process, wherein the frame and the face insert comprise different materials, wherein the face insert comprises a front insert material and a back insert material; and a sandwiched material between the front and back insert materials;

wherein the face insert includes a target area intended to interact with a golf ball when the golf ball is hit with the club head, and wherein the sandwiched material comprises a pattern of voids having smaller diameters in the target area and larger diameters in the non-target area.

2. The golf club head of claim 1, wherein the frame and the face insert each comprise a material selected from aluminum, steel, titanium, tungsten, magnesium, composite, and polymer.

3. The golf club head of claim 1, wherein the frame comprises aluminum and the face insert comprises titanium.

4. The golf club head of claim 1, wherein the front insert material comprises titanium, and the back insert material comprises a material selected from titanium, aluminum, steel, tungsten, magnesium, composite, and polymer.

5. The golf club head of claim 1, wherein the outer insert material and the inner insert material comprise titanium, and the sandwiched material is elastic or viscoelastic.

6. The golf club head of claim 1, wherein the forging process is a cold forging process.

7. The golf club head of claim 1, wherein the frame and face insert are not welded or bonded together.

8. The golf club head of claim 1, wherein the frame and face insert are welded at a back surface after being mechanically coupled.

* * * * *